US007278895B2

(12) United States Patent
Levander

(10) Patent No.: US 7,278,895 B2
(45) Date of Patent: Oct. 9, 2007

(54) MARINE VESSEL

(75) Inventor: Oskar Levander, Turku (FI)

(73) Assignee: Wartsila Finland Oy, Vaasa (FI)

( * ) Notice: Subject to any disclaimer, the term of this patent is extended or adjusted under 35 U.S.C. 154(b) by 0 days.

(21) Appl. No.: 11/354,741

(22) Filed: Feb. 14, 2006

(65) Prior Publication Data

US 2006/0201410 A1 Sep. 14, 2006

(30) Foreign Application Priority Data

Feb. 15, 2005 (FI) ..... 20055068

(51) Int. Cl.
*B63H 23/34* (2006.01)

(52) U.S. Cl. ..... 440/83; 114/72; 440/75

(58) Field of Classification Search ..... 114/144 R, 114/72; 440/53, 54, 58, 59, 72, 83, 52, 75
See application file for complete search history.

(56) References Cited

U.S. PATENT DOCUMENTS

| | | | | |
|---|---|---|---|---|
| 3,094,967 | A * | 6/1963 | Willis, Jr. | 440/58 |
| 3,734,050 | A * | 5/1973 | Kitai et al. | 440/59 |
| 4,027,553 | A * | 6/1977 | Eichinger et al. | 440/53 |
| 4,046,096 | A * | 9/1977 | Liaaen | 440/58 |
| 4,111,145 | A * | 9/1978 | Ohsaka | 114/72 |
| 4,273,545 | A | 6/1981 | Pehrsson et al. | |
| 4,634,389 | A * | 1/1987 | Eptaminitakis | 440/53 |

FOREIGN PATENT DOCUMENTS

| | | |
|---|---|---|
| FR | 2847550 | 5/2004 |
| GB | 1 477 704 | 6/1977 |
| GB | 1477704 | 6/1977 |
| WO | 01/54971 | 8/2001 |

OTHER PUBLICATIONS

"Cruise & Ferry Industry," Shipping World and Shipbuilder, Imarest Publications, London, United Kingdom, vol. 197, No. 4127, Oct. 1, 1996.

* cited by examiner

*Primary Examiner*—Lars A. Olson
(74) *Attorney, Agent, or Firm*—Smith-Hill and Bedell

(57) ABSTRACT

A marine vessel includes a hull and has at least one load carrying facility defined by at least one loading space with a given height, a given width and a given length, whereby the loading space is provided on a bulkhead deck, and a propulsion arrangement, which includes at least one steerable thruster unit connected by a shaft arrangement to a drive means. In order to provide better access to the bulkhead deck for loading and unloading the marine vessel, the steerable thruster unit is arranged below the bulkhead deck and the drive means is arranged above the loading space. The shaft arrangement comprises a substantially vertical shaft section extending from the drive means above the loading space through the given height of the loading space and to the steerable thruster unit below the bulkhead deck.

12 Claims, 2 Drawing Sheets

MARINE VESSEL

CROSS-REFERENCE TO RELATED APPLICATION

This application claims priority under 35 USC 119 of Finnish Patent Application No. 20055068 filed Feb. 15, 2005.

BACKGROUND OF THE INVENTION

The present invention relates to a marine vessel comprising a hull, which includes at least one load carrying facility defined by at least one loading space with a given height, a given width and a given length, which loading space is provided on a bulkhead deck, and a propulsion arrangement, which includes at least one steerable thruster unit connected by a shaft arrangement to a drive means.

In load carrying marine vessels, such as double end ferries, the propulsion arrangement may include one or more steerable thruster units for propelling and improving maneuverability of the vessel. Such thruster units are usually powered by electric motors or internal combustion engines, e.g. diesel engines. Freighters, container ships, RoRo and RoPax (RoRo passenger) are examples of other types of marine vessels in this context.

When the thruster is powered by an electric motor the motor conventionally is arranged directly overhead the steerable thruster unit, whereby it may be on or extending through the bulkhead deck. Power is transmitted to the propeller of the steerable thruster unit by means of a so-called L-drive unit comprising a drive shaft extending from the electric motor into the thruster, and in the thruster connecting to an angle gear and a propeller shaft with a propeller.

When the thruster is powered by an internal combustion engine the engine conventionally is arranged further into the ship, whereby the shaft line or gear box connected thereto as well as the engine may be on or extending through the bulkhead deck. Power is transmitted to the propeller of the steerable thruster unit by means of a so-called Z-drive unit comprising a shaft line extending from the internal combustion engine towards the steerable thruster unit, a gear box with an angle gear arranged directly overhead the steerable thruster unit, a drive shaft extending from the gear box into the thruster, and in the thruster connecting to a second angle gear and a propeller shaft with a propeller.

In practice, especially with high power steerable thrusters, this means that either the electric motor or the internal combustion engine form large obstructions extending through and rising above the bulkhead deck which in the above mentioned type of marine vessels typically would be the main car deck. This clearly is problematic in view of loading and unloading, and also with regard to availability of loading space. Considering that the loading space on the bulkhead deck has a given width, a significant part of the given width is occupied by the usually rather voluminous or bulky electrical motor, gear box or engine housings, either in the middle (in the case of a vessel with a single thruster) or one on each side of the marine vessel (in the case of a vessel with two thrusters). This reduces the number of available lanes on the loading or unloading ramps as well as the available loading space, which makes cargo loading and unloading slow and also complicates the distribution of cargo on the bulkhead deck.

The term bulkhead deck, which has been used above and will be used further on, has a definite meaning in shipbuilding. In the present application, however, this term should be understood in a more general manner, i.e. representing the main car deck, RoRo-car deck, or main cargo deck on a marine vessel. In the following the term upper deck will also be used. This term also has a definite meaning in shipbuilding. In the present application, however, this term should be understood in a more general manner, i.e. representing a deck above the one or more loading spaces on top of each other on a marine vessel.

The object of the present invention is to provide a marine vessel by which the above mentioned disadvantages are avoided and which provides facilitated and faster loading and unloading as well as maximizes the utilization of the loading space.

SUMMARY OF THE INVENTION

The basic idea of the invention is to clear the loading space on a marine vessel and to separate the loading space from any actual machinery arrangements. This is realized by arranging the steerable thruster unit below the bulkhead deck and the drive means for the thruster unit above the loading space, on an upper deck (as defined above). The connection between the drive means and the thruster unit is then provided with a substantially vertical or generally vertically oriented shaft section which extends over the given height of the loading space. Consequently, only this narrow shaft section appears on the bulkhead deck. This minimizes any obstructions on the given width of the loading space. Further, any maintenance, repair or replacement work necessary to the drive means may be carried out outside the loading space on the bulkhead deck.

In the following this shaft section will be called vertical shaft section. However, this should be understood in a more general manner, i.e. not only as strictly vertical.

An advantage of this invention is that it may be applied both to electrical and mechanical machinery arrangements, i.e. drive means.

Further, the invention may be applied with the same advantages regardless the number of loading spaces, i.e. the number of decks, situated on top of each other.

There is an additional advantage relating to increased loading and unloading space when the marine vessel employs two or more steerable thruster units.

The invention may be applied regardless whether the steerable thruster units are installed in the stern or at the bow of the marine vessel, or whether steerable thruster units are installed at both locations.

BRIEF DESCRIPTION OF THE DRAWINGS

In the following the invention is explained more in detail, by way of example only, with reference to the enclosed schematic drawings, in which.

DETAILED DESCRIPTION

Figure 1:
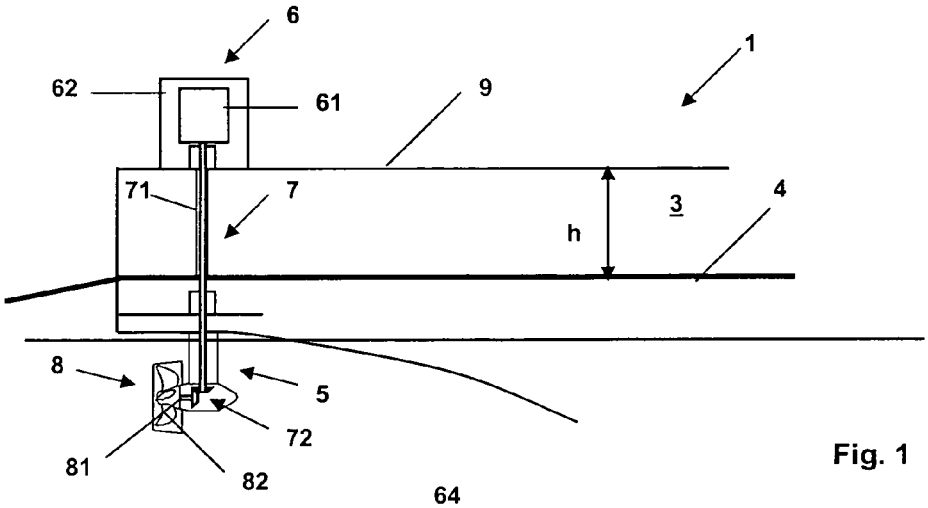
FIG. 1 shows a first embodiment of the present invention.

In the drawings reference numeral 1 indicates a marine vessel, reference numeral 2 a hull of the marine vessel, reference numeral 3 a loading space of the marine vessel, reference numeral 4 a bulkhead deck of the marine vessel, and reference numeral 5 a propulsion arrangement of the marine vessel. The loading space 3 has a given height h, a given width w and a given length l. The propulsion arrangement 5 comprises a drive means 6, a shaft arrangement 7 and a steerable thruster unit 8. The thruster unit is a so-called mechanical thruster.

FIG. 1 shows a first embodiment of the invention. In this embodiment the drive means 6 is an electrical motor 61, which is enclosed in a motor casing 62. The electrical motor is disposed above the loading space 3, on an upper deck 9. The steerable thruster unit 8 is below the bulkhead deck 4, i.e. below the loading space 3. The shaft arrangement 7 transferring power from the electrical motor 61 to the steerable thruster unit 8 comprises a vertical shaft section 71, which extends from the electrical motor 61 through the height h of the loading space 3 to a first angle gear 72 in the steerable thruster unit. The steerable thruster unit 8 is provided with a propeller 81 on a propeller shaft 82 connecting to the first angle gear 72. An arrangement like this is often called an L-drive.

As a consequence of the above arrangement, the only obstruction on the bulkhead deck 4 and in the loading space 3 due to the propulsion arrangement 5 is the narrow vertical shaft section 71 of the shaft arrangement 7. This provides the advantages of the invention described above.

Figure 2:
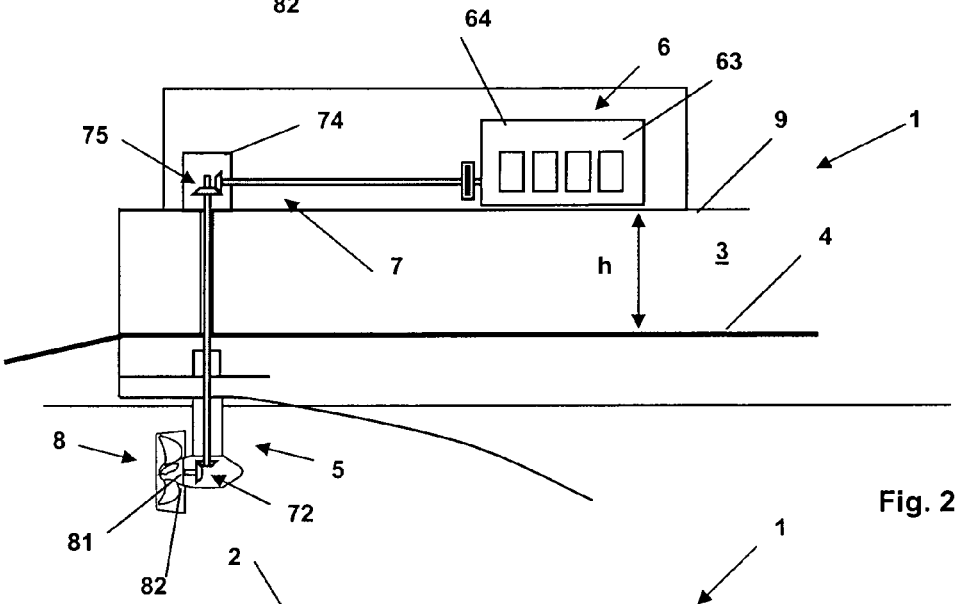
FIG. 2 shows a second embodiment of the present invention.

FIG. 2 shows a second embodiment of the present invention. In this embodiment the drive means comprises an internal combustion engine, e.g. a diesel engine, which is enclosed in an engine casing 64. The internal combustion engine 63 is disposed above the loading space 3 on an upper deck 9. The steerable thruster unit 8 is below the bulkhead deck 4, i.e. below the loading space 3. The shaft arrangement transferring power from the internal combustion engine 63 to the steerable thruster unit 8 comprises a substantially horizontally arranged or horizontally oriented shaft line 73 extending to a gear box 74 on the upper deck 9 above the loading space 3. The gear box 74 includes a second angle gear 75 for connecting the shaft line 73 to a vertical shaft section 71. The vertical shaft section 71 extends from the gear box 74 through the height h of the loading space 3 to a first angle gear 72 in the steerable thruster unit 8. The steerable thruster unit 8 is provided with a propeller 81 on a propeller shaft 82 connecting to the first angle gear 72. An arrangement like this is often called a Z-drive.

Similarly to the embodiment shown in FIG. 1, the only obstruction on the bulkhead deck 4 and in the loading space 3 due to the propulsion arrangement 5 is the narrow vertical shaft section 71 of the shaft arrangement 7, which provides the advantages of the invention described above.

Figure 3:
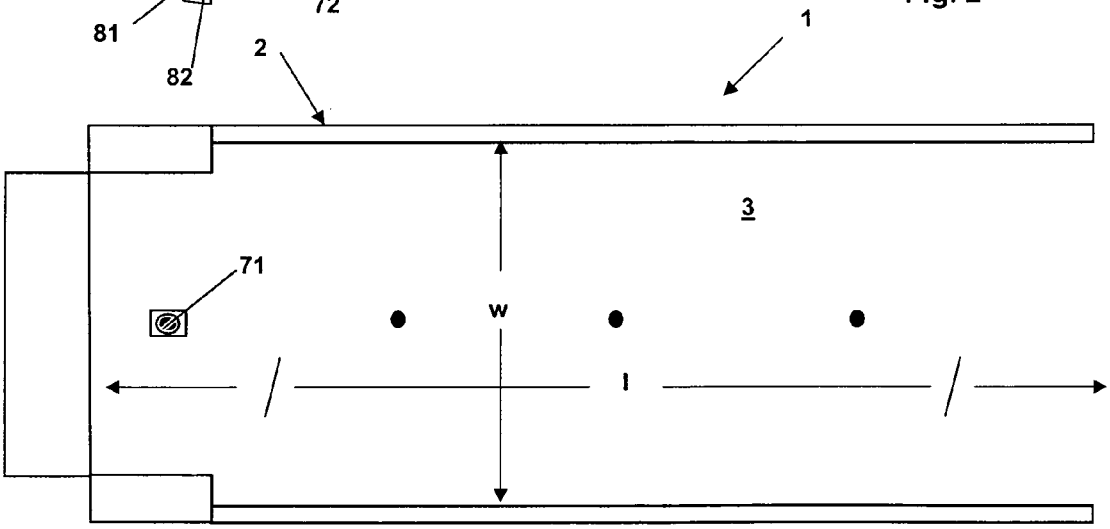
FIG. 3 shows a plan view of a loading space.

FIG. 3 shows a plan view of the loading space 3 for clarifying the arrangement of the vertical shaft section 71 in the loading space. It can be seen in FIG. 3 that the narrow vertical shaft section 71 occupies only a minute part of the width w of the loading space 3.

Figure 4:
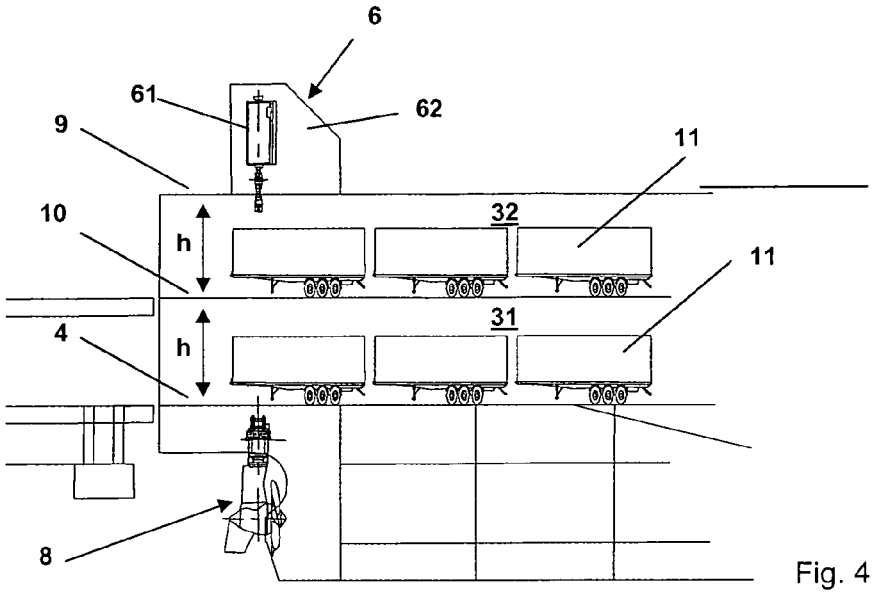
FIG. 4 shows a side view of a marine vessel stern end.
Figure 5:
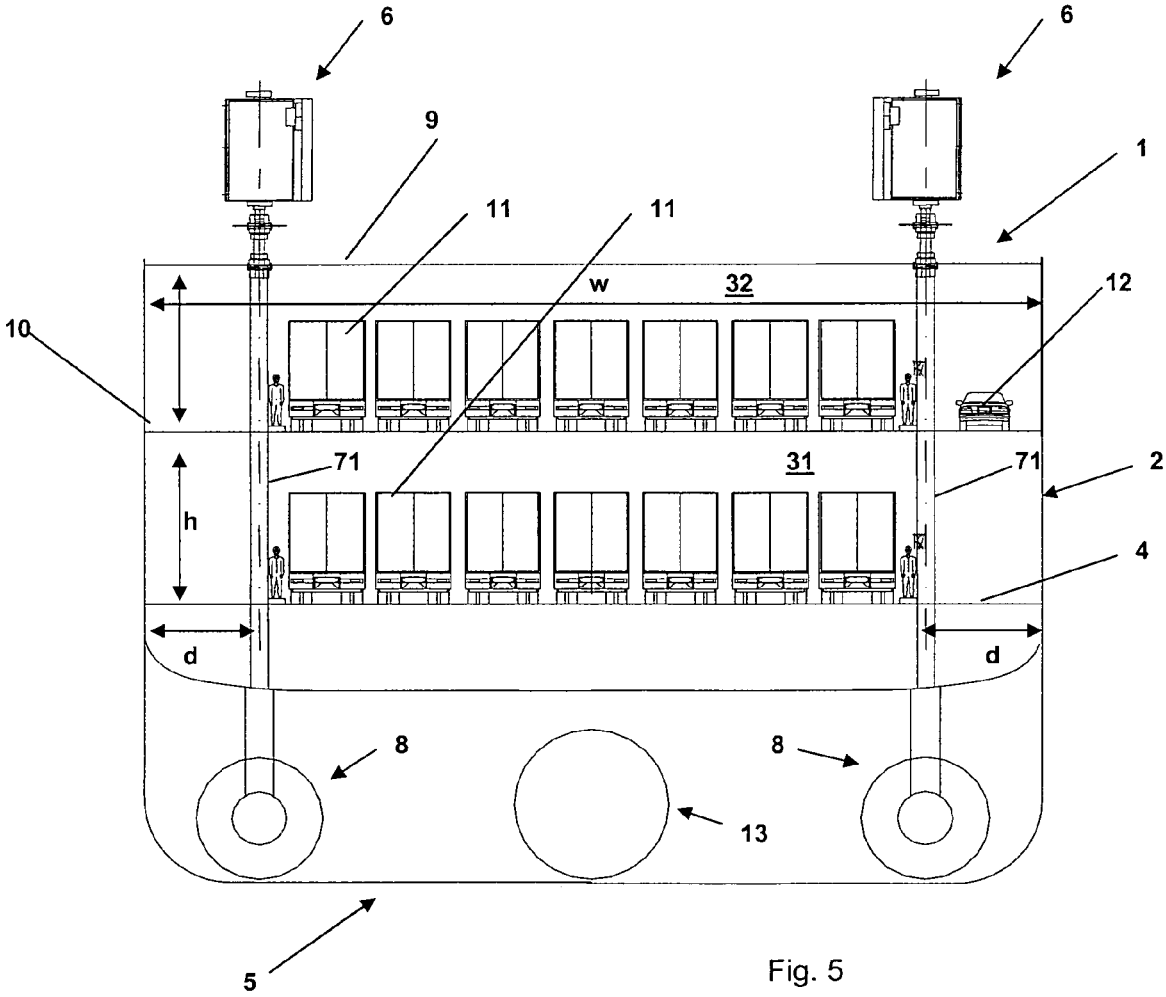
FIG. 5 shows a rear view of the marine vessel.

FIG. 4 and FIG. 5 illustrate a marine vessel 1 provided with a first loading space 31 and a second loading space 32 on top of each other and separated by a middle deck 10. In this embodiment the drive means, in FIG. 4 indicated as an electrical motor 61 with a motor casing 62, are disposed on an upper deck 9, which is above the second loading space 32. The steerable thruster unit 8 is disposed below the bulkhead deck 4, i.e. below the first loading space 31. The vertical shaft section 71 thus extends through the height of both loading spaces, i.e. the height h of the second loading space 32 as well as through the height h of the first loading space 31, whereby the narrow vertical shaft section 71 forms the only obstruction on the bulkhead deck 4 as well as on the middle deck 10 due to the propulsion arrangement 5, providing similar advantages as described above. In this case the vertical shaft section is longer and may be provided with bearings to increase stability. Such bearings (not shown) would preferably be arranged just under the middle deck 10 so that they would not provide any obstructions.

The figures also schematically show a number of trailers 11 on the bulkhead deck 4 and the middle deck 10.

The marine vessel 1 is provided with two steerable thruster units 8, one on each of the two opposite sides of the hull 2. Preferably the steerable thruster units 8 are at a given distance from the outer sides of the hull 2 so that when the steerable thruster units 8 are rotated, they do not extend beyond the outer sides. The given distance is indicate in FIG. 5 with reference d as extending between the center of the vertical shaft section 71 (providing the rotational center) and the side of the hull 2.

FIG. 5 further exemplifies the advantages of the present invention. The bulkhead deck 4 and the middle deck 10 function as car or vehicle decks, and the narrow vertical shaft sections 71 practically form almost no obstructions that would limit the number of available lanes on the loading or unloading ramps leading to these decks. Advantageously, the vertical shaft sections 71 are also distanced from the sides of the hull 2 so that an additional ramp or cargo lane to an upper deck may be provided between each vertical shaft section and the closer side of the hull, e.g. as indicated by a vehicle 12 on the middle deck 10, on the right side of the marine vessel 1 (FIG. 5). Alternatively the hull could have narrower side casings, if this space would not be used.

The number of loading spaces situated on top of each other may vary, i.e. be more than two, and they may have different heights. The drive means need not necessarily be arranged above the uppermost loading space or deck.

The drawings schematically show the steerable thruster unit as being in the stern of the marine vessel. However, it may alternately be in the bow, or thruster units may be provided both in the stern and in the bow.

FIG. 5 also shows that the propulsion arrangement 5 may include a conventionally shafted propeller 13. The shaft and machine arrangements of this are normally further into the marine vessel, whereby they as such would not provide any obstructions. The marine vessel could also be provided with CRP (contra-rotating propeller) propulsion.

The drawings and the description related thereto are only intended for clarifying the basic idea of the invention, whereby the invention in detail may vary within the scope of the ensuing claims.

The invention claimed is:

1. A marine vessel comprising:

a hull defining a loading space, a bulkhead deck, the loading space being provided on the bulkhead deck and being of a height h, a steerable thruster unit below the bulkhead deck, a drive means above the loading space, and a shaft arrangement that connects the drive means to the thruster unit, for transmitting mechanical effort from the drive means to the thruster unit, and includes a shaft that extends substantially vertically through the height h of the loading space and has an upper end and a lower end, the upper end of the shaft being above the loading space and the lower end of the shaft being below the loading space.

2. A marine vessel according to claim 1, comprising an upper deck above the loading space and wherein the drive means is disposed on the upper deck.

3. A marine vessel according to claim 2, wherein the drive means comprises an electric motor and said shaft extends from the electric motor to a first angle gear in the steerable thruster unit.

4. A marine vessel according to claim 2, wherein the drive means comprises an internal combustion engine, the shaft arrangement includes a shaft line that extends from the internal combustion engine to a second angle gear, and said shaft section extends from the second angle gear to a first angle gear in the steerable thruster unit.

5. A marine vessel according to claim 4, wherein the second angle gear and the shaft line are disposed on the upper deck.

6. A marine vessel according to claim 5, wherein the second angle gear is located in a gear box and the gear box is disposed on the upper deck.

7. A marine vessel according to claim 1, comprising two steerable thruster units on opposite respective sides of the hull of the marine vessel.

8. A marine vessel according to claim 7, wherein the steerable thruster units are located sufficiently inboard of the outer sides of the hull that they can be rotated without extending outboard of said outer sides.

9. A marine vessel according to claim 1, wherein the steerable thruster unit is located at an end of the hull.

10. A marine vessel according to claim 9, wherein the steerable thruster unit is located at the stern end of the hull.

11. A marine vessel according to claim 1, further comprising a shafted propeller.

12. A marine vessel comprising:

a hull defining a first loading space, a bulkhead deck, the first loading space being provided on the bulkhead deck and being of a height h, a steerable thruster unit below the bulkhead deck, a drive means above the first loading space, and a shaft arrangement that connects the drive means to the thruster unit, for transmitting mechanical effort from the drive means to the thruster unit, and includes a shaft that extends substantially vertically through the height h of the first loading space and has an upper end and a lower end, the upper end of the shaft being above the loading space and the lower end of the shaft being below the loading space, and wherein the vessel defines at least one additional loading space above the first loading space and the drive means is above said one additional loading space.

* * * * *